US005174249A

United States Patent [19]

Katou

[11] Patent Number: 5,174,249

[45] Date of Patent: Dec. 29, 1992

[54] PISTON COOLING DEVICE FOR INTERNAL COMBUSTION ENGINE

[75] Inventor: Zenichirou Katou, Mishima, Japan

[73] Assignee: Toyota Jidosha Kabushiki Kaisha, Toyota, Japan

[21] Appl. No.: 686,514

[22] Filed: Apr. 17, 1991

[30] Foreign Application Priority Data

Jul. 13, 1990 [JP] Japan ..... 2-186815

[51] Int. Cl.[5] ..... F01P 1/04

[52] U.S. Cl. ..... 123/41.38

[58] Field of Search ..... 123/41.35, 41.38; 184/6.5

[56] References Cited

U.S. PATENT DOCUMENTS

| | | | |
|---|---|---|---|
| 2,142,175 | 1/1939 | Buttner | 123/41.38 |
| 2,236,401 | 3/1941 | Gehres | 123/41.38 |
| 2,362,158 | 11/1944 | Ricardo | 123/41.38 |
| 2,428,602 | 10/1947 | Yingling | 123/41.38 |
| 2,449,657 | 9/1948 | Kishline | 123/41.38 |
| 4,398,507 | 8/1983 | Belsanti | 123/41.38 |

FOREIGN PATENT DOCUMENTS

| | | | |
|---|---|---|---|
| 57-126503 | 1/1956 | Japan . | |
| 53-70237 | 6/1978 | Japan . | |
| 58-106612 | 7/1983 | Japan . | |
| 59-58724 | 4/1984 | Japan . | |
| 59-184344 | 12/1984 | Japan . | |
| 60-26229 | 2/1985 | Japan . | |
| 62-44169 | 11/1987 | Japan . | |
| 547111 | 8/1942 | United Kingdom | 123/41.38 |

OTHER PUBLICATIONS

Nissan Technical Review, May 25, 1989, Nissan Motor Co., Ltd. (w. translation of summary on p. 49).

*Primary Examiner*—Noah P. Kamen

*Attorney, Agent, or Firm*—Kenyon & Kenyon

[57] ABSTRACT

A piston cooling device for internal combustion engines is disclosed. Lubricating oil discharged from an oil pump is led through an inlet provided on an external peripheral surface of a main journal into a first oil passage and is further delivered to an outlet provided on the opposite side of the crankshaft as the inlet. A crank pin is rotatably received by an end portion of a connecting rod, having a bearing surface interposed therebetween. A clearance is provided between the bearing surface and the crank pin. A second oil passage is provided at the connecting rod, communicating with the clearance. A port formed on the bearing surface makes the first oil passage communicate with the clearance and with the second oil passage when a crank angle comes to a range of between 0 and 90 degrees before a piston dead center position or when the inertia load applied to between the end portion of the connecting rod and the crank pin becomes is minimized. This arrangement delivers lubricating oil to the clearance to form an oil film that provides good lubrication. Additionally oil is sprayed from the second oil passage to cool the piston.

3 Claims, 5 Drawing Sheets

PISTON COOLING DEVICE FOR INTERNAL COMBUSTION ENGINE

BACKGROUND OF THE INVENTION

1. FIELD OF THE INVENTION

The present invention relates generally to a cooling device for internal combustion engines. More particularly, it relates to a device for cooling pistons in internal combustion engines by means of sprayed lubricating oil.

2. DESCRIPTION OF THE RELATED ART

It is desirable for pistons in internal combustion engines to be cooled by lubricating oil or the like. Cooling the pistons increases its torque and prevents the engine from knocking, resulting in improved fuel consumption. One such type of cooling systems sprays lubricating oil on the rear surface of the piston. In such a system, oil passages run through the crank shaft and connecting rod to the piston for delivering the lubricating oil.

One such lubricating oil supplying structure is disclosed in Japanese Laid-Open Utility Model Publication No. 58-106612. As shown in FIG. 5, this structure has an oil passage 105 running from a main journal 109 in a crank shaft 115 to a crank pin 103. Ports 106 are provided on a metal bearing 102, and an oil passage 104 extends along a longitudinal axis of a connecting rod 101. The passages 104 and 105 and the ports 106 communicate with one another as shown in the drawing. In FIG. 5, the rotating direction of the crank shaft 115 is clockwise.

According to the foregoing structure, the lubricating oil for cooling the piston is led through a running route described below and is supplied and sprayed at least once each cycle. In successive cycles, the supplying and spraying are repeated in the same manner.

The lubricating oil is delivered to a bearing (not shown) in the main journal 109 of the crank shaft 115 by means of an oil pump. After the lubricating oil lubricates the bearing, the lubricating oil is led into an oil passage 113 provided on the periphery of the main journal 109. The oil passage 113 communicates with the oil passage 105. The oil passage 105 communicates with the outside by way of a bore 108 defined on the periphery of the crank pin 103. Accordingly, the lubrication oil always remains in a clearance between the crank pin 103 and the bearing 102.

The bearing 102 is fixed to the connecting rod 101, and the crank pin 103 moves relative to the bearing. When the crank pin 103 comes to a position shown in FIG. 5, the bore 108 corresponds to and communicates with one of the ports 106. A part of the lubricating oil supplied from the bore 108 remains in the clearance to form an oil film, but most of the oil is led through a notch 107 into passage 104. The lubricating oil in the passage 104 is then delivered to a notch 112 formed at a distal end portion of the connecting rod 101 and stays at a position adjacent to a bore 110.

Then, when the piston 116 reaches the top dead center, and turns downward, the inertia of the lubricating oil is generally directed upwards. The lubricating oil can not stay in the oil passage 104 due to the inertial force and is thus sprayed towards the rear surface of the piston 116. Especially after the piston 116 passes the compression top dead center, the combustion force bears more downward acceleration upon the connecting rod 101. Accordingly, the upward inertia force upon the lubricating oil also increases, resulting in a larger pressure for spraying the lubricating oil which now acts as a coolant. When both the ports 106 and 108 communicate with each other again in the next cycle, the lubricating oil is supplied into the oil passage 104 in the connecting rod 101 in the same manner and is sprayed again immediately after the piston 116 passes the top dead center. The foregoing cycle is repeated as described above, so that the piston 116 is cooled when the engine works.

As shown in FIG. 5, there a clearance is provided between the bearing 102 and the crank pin 103, to receive oil therein. When the engine is at work, the lubricating oil is supplied from the bore 108 and an oil film is formed in the clearance. This facilitates the lubrication of the sliding surfaces between the crank pin 103 and the bearing 102. Accordingly, it is necessary to supply a predetermined amount of lubricating oil to the clearance to maintain the oil film and achieve the desired lubricating effect.

During the combustion cycle, the center of a large end portion of the connecting rod 101 is likely to be slightly displaced from that of the crank pin 103 due to the inertia loads caused by the up/down and rotating motions of the connecting rod 101. Therefore, a volume of the foregoing clearance often inevitably becomes smaller, resulting in that the oil film is pressed and deformed. The deformation of the oil film in the clearance is described below. In the following description, when the oil film is said to be the thinnest it means that the oil film is deformed the most.

FIG. 6 (*b*) is a polar coordinate showing the displacements of the center of the proximal end portion of the connecting rod 101 relative to the center of the crank pin 103, having the compression top dead center as a starting point. The coordinate is set as shown in FIG. 6 (*a*), and an external circle represents the maximum volume of the clearance.

In regions Q and Q' in the graph shown in FIG. 6 (*b*), the crank angle is in the range between 0 and 90 degrees from the top or bottom dead center. Within these regions Q and Q', the center of the proximal end portion of the connecting rod 101 is displaced from the center of the crank pin 103 the most significantly compared with the other periods in the cycle. For example, during Q the crank pin 103 is located at a far upper right part of the proximal end portion of the connecting rod 101. The reason for the displacement is that the connecting rod 101 and the crank pin 103 tend to move apart from each other just before and after a piston reaches the top or bottom dead center. This is because that at such times the piston 116 tends to move in a first direction because of its inertia while the crank pin 103 turns in the reverse direction.

As the connecting rod 101 and the crank pin 103 move apart from each other at these times, the center of the proximal end portion is displaced from the center of the crank pin 103 the most significantly which in turn causes the thinnest oil film. Moreover, the crank pin 103 rotates relative to the bearing 102, so that the oil film is pressed and deformed between the internal surface of the bearing 102 and the external surface of the crank pin 103. In this condition, the actual position of the thinnest oil layer moves along the internal surface of the bearing 102. Accordingly, the oil film is very rapidly pressed and deformed, so that there is no enough time for all the lubricating oil forming the oil film to move into a wider area within the clearance. Rather, a considerable amount falls off from side edges of the bearing 102.

Accordingly, sufficient new lubricating oil must be supplied to the clearance to compensate for oil that falls away due to the deformation.

However, in the lubricating oil supplying device disclosed in Japanese Laid-Open Utility Model No. 58-106612, the port 106 and bores 108 are aligned and communicate with each other just after the piston passes the top dead center as shown in FIG. 5. Accordingly, even though the amount of lubricating oil falling off from the side edges of the bearing 102 is relatively large just after the piston reaches the top dead center, at that time, most of the lubricating oil is delivered into the oil passage 104 in the connecting rod 101. Consequently, insufficient lubricating oil may be supplied to the clearance which prevents the oil film from being formed and causes a problem due to a lack of lubrication between the bearing 102 and the crank pin 103.

SUMMARY OF THE INVENTION

Accordingly, it is a primary object of the present invention to provide a piston cooling device for internal combustion engines wherein excellent lubrication can be maintained throughout the entire operational cycle.

Another object of the present invention is to provide a piston cooling device with excellent mechanical strength.

To achieve the foregoing and other objects and in accordance with the purpose of the present invention, an improved piston cooling system for internal combustion engines is provided. The piston cooling system includes a first oil passage formed in the crank shaft for receiving lubricating oil from a lubricating oil supply source. A second oil passage is formed in the connecting rod and has an opening at its distal end that is directed towards the piston head. A clearance is formed between the race surface of the connecting rod and the external surface of a crank pin. The clearance is in communication with the second oil passage. A communication port in the race surface is positioned on the opposite side of said crankshaft as the oil supply source to allow the first oil passage to communicate with the second oil passage and the clearance. The communication port position is carefully chosen so that communication occurs when the inertial load between the connecting rod and the crankshaft is near its minimum before the piston head reaches a dead center position. This minimum position is within 90° before the piston reaches a dead center position.

In a preferred embodiment of the invention, the communication port is positioned to allow communication when the crank angle is approximately 40° before a dead center position. The dead center position may be either top dead center or bottom dead center.

BRIEF DESCRIPTION OF THE DRAWING

The features of the present invention that are believed to be novel are set forth with particularly in the appended claims. The invention, together with the objects and advantages thereof, may best be understood by reference to the following description of the presently preferred embodiments together with the accompanying drawings in which:

FIG. 6 (*b*) is a graph with the same polar coordinates as the graph shown in FIG. 3.

DETAILED DESCRIPTION OF THE PREFERRED EMBODIMENT

Figure 1:
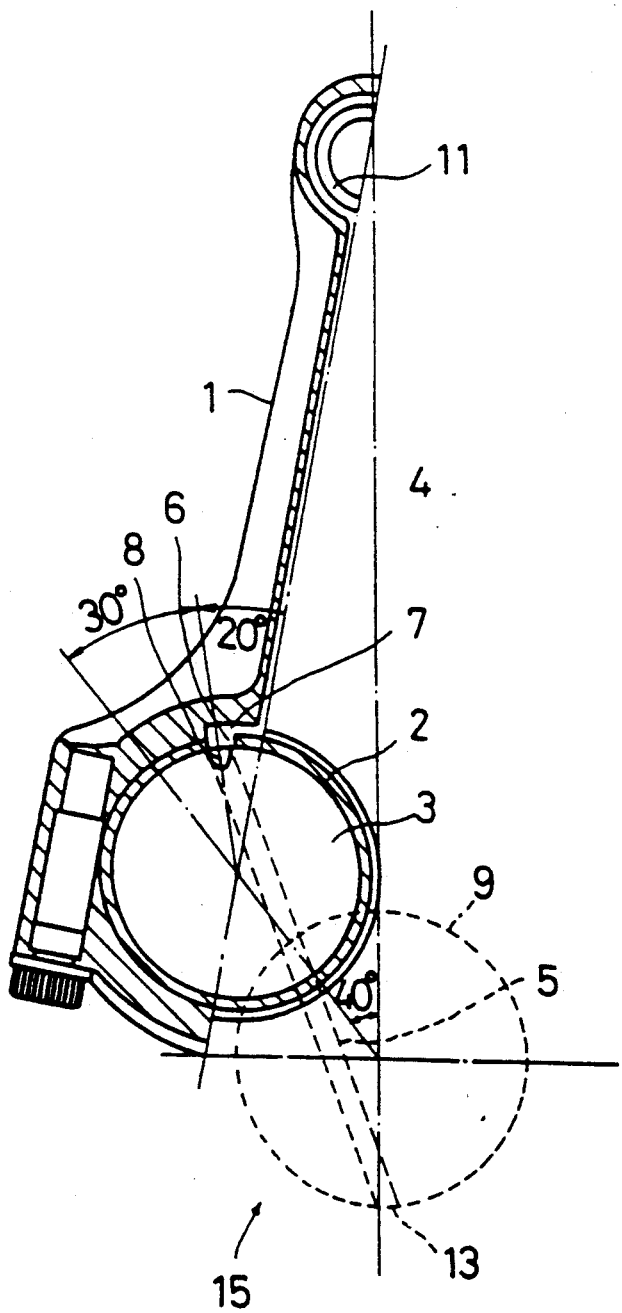
FIG. 1 is a vertical sectional view of the first embodiment of the present invention.
Figure 2:
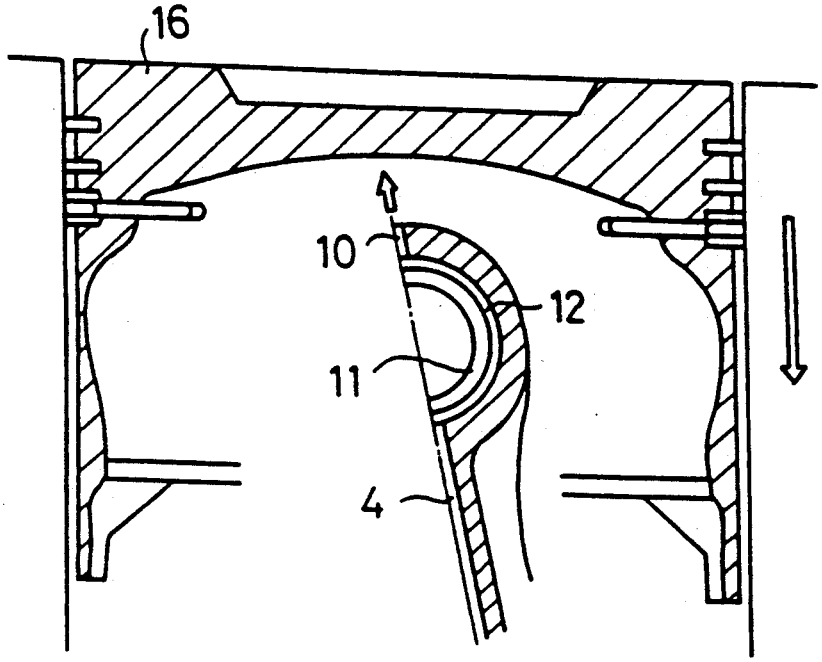
FIG. 2 is a partial sectional view showing a portion adjacent to a distal end portion of a connecting rod.
Figure 3:
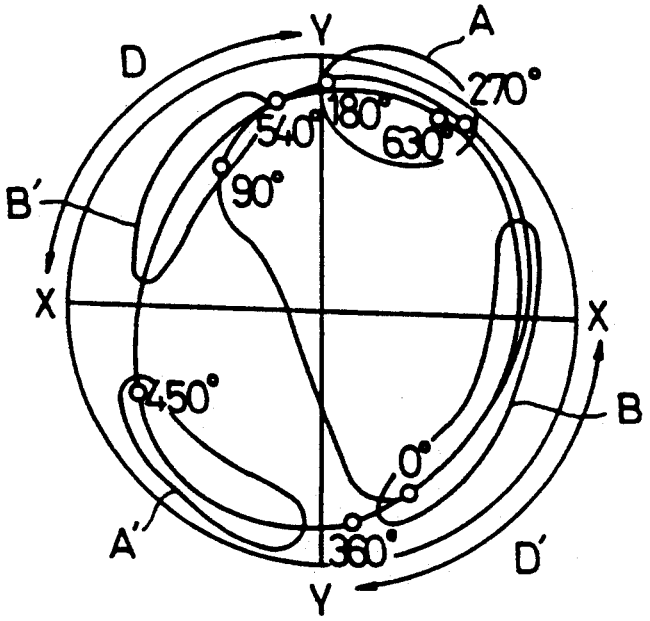
FIG. 3 is a graph with a polar coordinate, showing displacements of a center of a crank pin relative to a center of a proximal end portion of a connecting rod from the perspective of the connecting rod.

As illustrated in the drawings, preferred embodiments of the present invention will be described in detail hereinafter. The first embodiment is shown in FIGS. 1 to 3, and the second embodiment in FIG. 4. In FIGS. 1 to 4, the rotational direction of a crank shaft is clockwise.

The first embodiment is now described referring to FIGS. 1 to 3. In FIG. 1, a connecting rod 1, a bearing 2, a crank pin 3, a crank shaft 15 and a main journal 9 of the crank shaft 15 are all conventional members.

A first oil passage 5 is defined in the crank shaft 15 through the main journal 9 and the crank pin 3. A second oil passage 4 is formed in the connecting rod 1, running along a longitudinal axis thereof. The bearing 2 has a port 6 communicating with an external surface and an internal surface of the bearing 2. The port 6 is located at a position apart from the lower end of the second oil passage 4 to the left by an angle of about 20 degrees. In addition, a notch 7 is defined in a proximal end portion of the connecting rod 1, communicating with the port 6 and with the second oil passage 4.

A bore 8 is provided on a peripheral surface of the crank pin 3 and is aligned with the port 6 when the crank angle is 40 degrees from the top dead center position for piston 16. In other words, the bore 8 is arranged at a position apart from a selected point on the peripheral surface of the crank pin 3 to the left by an angle of about 30 degrees about the center of the crank pin 3. The selected point is determined in the following way. When an imaginary straight line is drawn passing through the centers of the crank pin 3 and of the main journal 9, the line crosses the peripheral surface of the crank pin 3 at two points. Of these two points, the one located further from the main journal 9 is the selected point.

As shown in FIG. 2, a piston pin 11 is received by an opening in the distal end portion of the connecting rod 1. A notch 12 is defined at an internal peripheral surface of the opening and communicates with the second oil passage 4. The distal end portion of the connecting rod also has a bore 10 at a tip thereof. The bore 10 communicates with the notch 12 and has an internal diameter smaller than that of the second oil passage 4.

The operation of the foregoing design will now be described. Lubricating oil is delivered to a not shown bearing of the main journal 9 by means of an oil pump and lubricates this bearing. Then, the lubricating oil is led into the first oil passage 5 through a bore 13 defined on the peripheral surface of the main journal 9. The lubricating oil runs through the first oil passage 5 and is discharged out of the bore 8. Thus, the lubricating oil is always supplied to the clearance between the crank pin 3 and the bearing 2 through the bore 8 on the crank pin 3.

When the crank angle reaches 40 degrees before the top dead center position, the bore 8 is aligned with and communicates with the port 6. Accordingly, the lubricating oil coming out of the bore 8 is led into the notch 7 through the port 6 and is supplied to the second oil passage 4. At the same time, a part of the lubricating oil is still supplied to the clearance. At this time, the bore 8 is located at the peripheral surface of the crank pin 3 on the side positioned away from the axis of the main journal. Thus, the internal pressure of the lubricating oil increases because of centrifugal force. Accordingly, the clearance can be supplied with a sufficient amount of the lubricating oil. Moreover, at this position namely at 40 degrees before the top dead center, the proximal end portion of the connecting rod 1 and the crank pin 3 have the smallest inertia load therebetween. In graphic terms, the clearance is within a region B in the graph shown in FIG. 3. Accordingly, the deformation of the oil film in the clearance is the least significant at this time, so that the least amount of the lubricating oil is forced from the side edges of the bearing 2.

Because of the communication between the port 6 and bore 8, lubricating oil is supplied to the second oil passage 4 through the notch 7. Then, almost instantaneously when the piston 16 reaches the top dead center, and when the upward inertia force and the explosion force is highest, the lubricating oil runs through the notch 12 and is sprayed out of the bore 10 onto the rear surface of the piston 16. In gasoline engines in general, the explosion pressure is highest at a crank angle of about 10 degrees after top dead center. So the temperature of the piston 16 is the highest at this time. Accordingly, the lubricating oil as a coolant is supplied to the piston 16 when the temperature is the highest in this embodiment.

According to the foregoing design and operations, the first embodiment of the present invention has the following effects. When the port 6 and bore 8 correspond to and communicate with each other, the deformation of the oil film due to the inertia load of the piston 16 is the least significant. Thus, the smallest amount of the lubricating oil falls off from the side edges of the bearing 2, and the oil pressure is increased by a centrifugal force. Therefore, though the lubricating oil is being supplied to the second oil passage 4 at this time, enough lubricating oil remains in the clearance to compensate the oil that slips from the side edges of the bearing 2. Consequently, good lubrication is provided.

If the port 6 is provided on the bearing 2 at a position where the oil film is deformed the most significantly, most of the lubricating oil would be discharged out of the port 6 and the oil film would be poorly formed. This would occur if the oil passages communicate when the displacement of the crank pin 3 relative to the bearing 2 is the largest during the cycle as shown as regions A and A' in FIG. 3,. Thus, the port 6 should be defined at a position where the deformation of the oil film is small as shown as D and D' in FIG. 3. In the present embodiment, the port 6 is positioned within the region D', which results in a good oil film that can be maintained even when the bearing rotation passes the regions A and A'.

In the present embodiment, the port 6 on the bearing 2 is arranged relatively adjacent to the lower end of the second oil passage 4. Accordingly, the notch 7 can be made short, which provides an improved mechanical strength.

The bore 10 at the distal end portion of the connecting rod 1 has a relatively small diameter, resulting in a high spraying pressure when the lubricating oil is sprayed. Accordingly, the lubricating oil or the coolant can be supplied to the rear surface of the piston 16 even when the oil temperature is low and its viscosity is still high.

Figure 4:
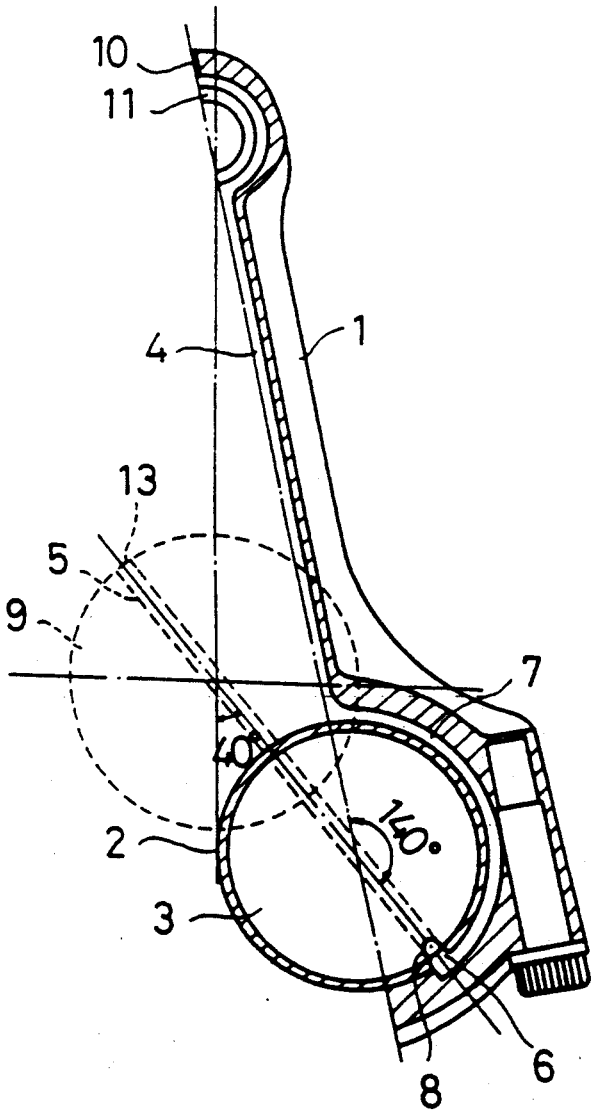
FIG. 4 is a vertical sectional view of a second embodiment of the present invention.
Figure 5:
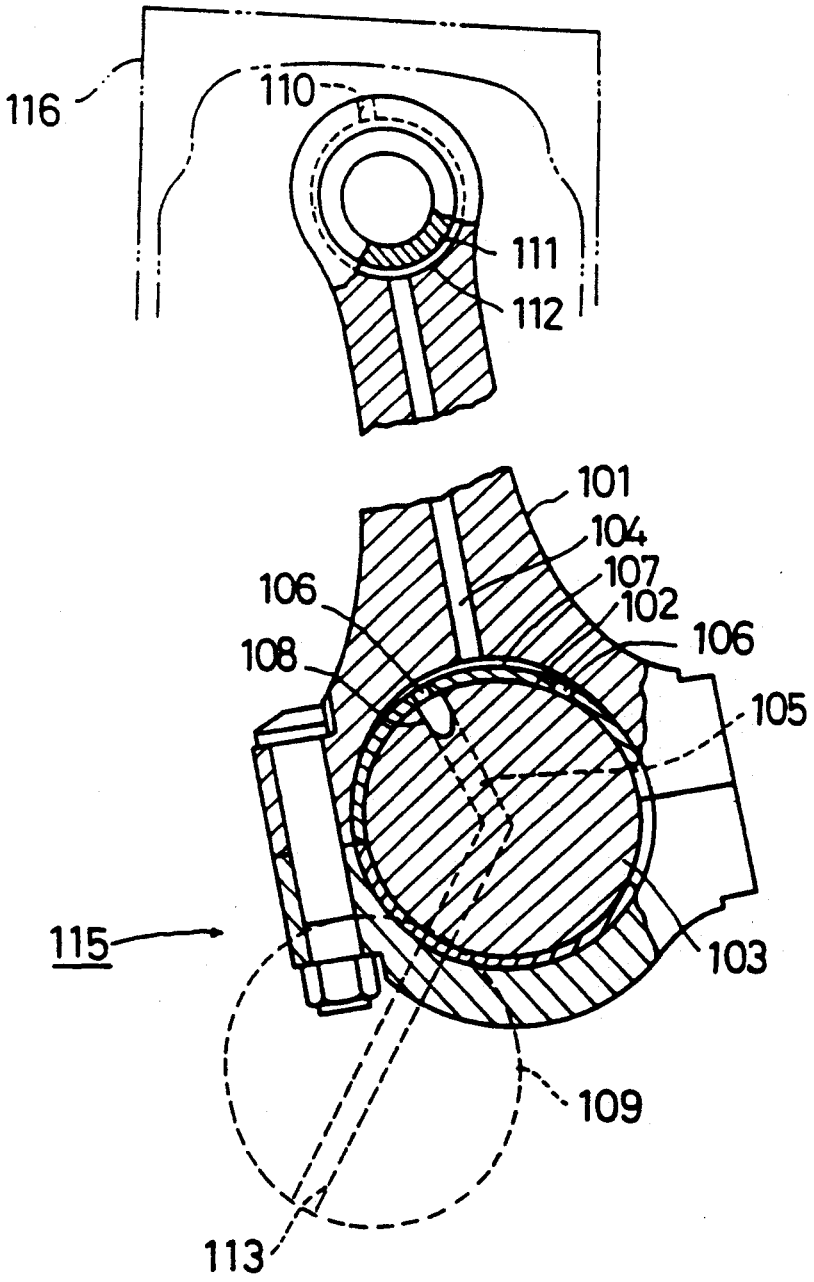
FIG. 5 PRIOR ART
FIG. 5 is a vertical sectional view of a prior art design.
Figure 6A:
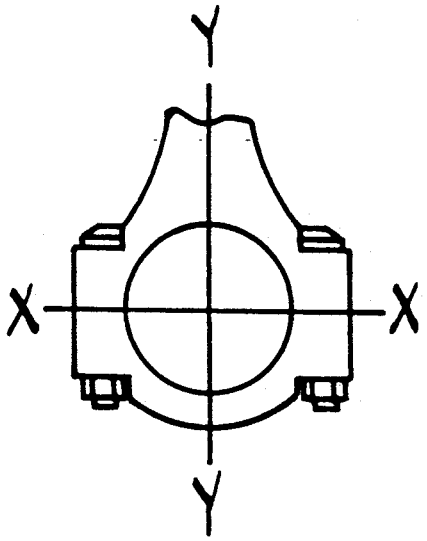
FIG. 6 (*a*) is a front view of the proximal end portion of the connecting rod shown with the coordinate.
Figure 6B:
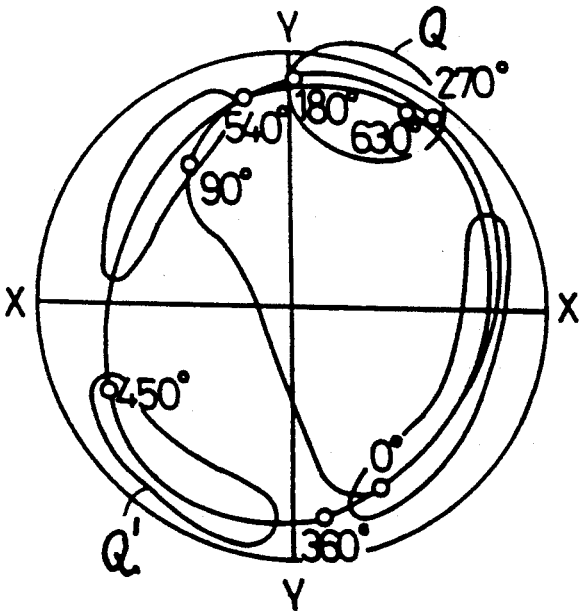

The second embodiment is now described referring to FIG. 4. In the present embodiment, the same numeral codes are given to the same or corresponding members as in the first embodiment.

In this embodiment, a port 6 on the bearing 2 is located at a position 140 degrees clockwise away from the lower end of the second oil passage 4 about the center of the proximal end portion of the connecting rod 1. A notch 7 is defined at the proximal end portion, communicating with the port 6 and with the second oil passage 4. A bore 8 is provided on the crank pin 8 so as to align with the port 6 when the crank angle is 40 degrees before the piston 16 reaches the bottom dead center. In other words, the bore 8 is located at a position which is determined in the following way. When an imaginary straight line is drawn through the centers of the crank pin 3 and the main journal 9, the line crosses the peripheral surface of the crank pin 3 at two points. The bore 8 is located at the point which is positioned farther from the main journal 9.

The inertia load applied to between the proximal end portion and the crank pin 3 becomes the smallest at 40 degrees before the bottom dead center. In graphic terms, the clearance is within a region B' in the graph shown in FIG. 3. Accordingly, the deformation of the oil film in the clearance is the least significant at this time, so that the least amount of the lubricating oil is forced from the side edges of the bearing 2. The hole 8 is located on the peripheral surface of the crank pin 3 on the side positioned away from the main journal 9. Accordingly, for the same reasons described above with respect to the first embodiment, a sufficient amount of the lubricating oil can be supplied to the foregoing clearance without fail. Consequently, excellent lubrication can be achieved.

In the second embodiment, the same effects as in the first embodiment can be obtained. In addition, in the second embodiment, a shorter period of time is required to supply the lubricating oil to the second oil passage 4 after the previous oil has been sprayed out of the bore 10. Accordingly, a small amount of oil remains within the notch 12 for a shorter time period after spraying which results in improved lubrication at the distal end portion of the connecting rod 1.

In all other respects, the second embodiment may be the same as in the first described embodiment and brings about the same effects as the first embodiment.

Although only a few embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A piston cooling device for internal combustion engines having a connecting rod for coupling a crankshaft to a piston head, the connecting rod having a race surface that rotatably receives said crankshaft, the cooling device comprising:

a first oil passage formed in the crank shaft for receiving lubricating oil from a lubricating oil supply source, the first oil passage having an inlet and an outlet;

a second oil passage formed in the connecting rod and having an opening at a distal end of the connecting rod, the opening being directed towards the piston head; and a clearance defined between said race surface and an external peripheral surface of the crankshaft, the clearance communicating with the second oil passage; and a communication port positioned on an opposite side of said crankshaft as the oil supply source for allowing the first oil passage to communicate with the second oil passage and the clearance only at a crank angle in which the inertial load between the connecting rod and the crankshaft is near its minimum before the piston head reaches a dead center position, said crank angle being within a range of between 0 and 90 degrees before the piston reaches a bottom dead center position.

2. A piston cooling device for internal combustion engines as set forth in claim 1 wherein the communication port is positioned to cause the first oil passage to communicate with the second oil passage when the crank angle is substantially 40 degrees before the piston reaches the bottom dead center.

3. A piston cooling device for internal combustion engines having a crankshaft including a main journal and a crank pin, and a connecting rod for coupling the crankshaft to a piston head, the connecting rod having a bearing mounted therein for rotatably receiving said crank pin, the cooling device comprising:

a first oil passage formed in the crank shaft for receiving lubricating oil from a lubricating oil supply source, the first oil passage having an inlet and an outlet, the inlet being positioned on the external periphery of the main journal and the outlet being positioned in the crank pin at a position on the opposite side of the main journal as the inlet;

a second oil passage formed in the connecting rod and having an opening at a distal end of the connecting rod, the opening being directed towards the piston head; and a clearance defined between the inner surface of the bearing and an external surface of the crankshaft, the clearance communicating with the second oil passage; and a communication port in said bearing for allowing the first oil passage to communicate with the second oil passage and the clearance only when the crank angle is substantially 40 degrees before the pistion reaches the bottom dead center.

* * * * *